US011162723B2

(12) United States Patent
Wang et al.

(10) Patent No.: US 11,162,723 B2
(45) Date of Patent: Nov. 2, 2021

(54) METHODS AND SYSTEMS FOR CONTROLLING WORKING FLUID IN HVACR SYSTEMS

(71) Applicant: TRANE INTERNATIONAL INC., Davidson, NC (US)

(72) Inventors: Jun Wang, Shanghai (CN); Yves Jacques Raimbault, Charmes (FR); Daoud A. Jandal, La Crosse, WI (US); Todd J. Love, Brooklyn Park, MN (US); Kevin D. Pfaff, Melrose, WI (US); Fred Ahlstrom, Onalaska, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 143 days.

(21) Appl. No.: 16/370,406

(22) Filed: Mar. 29, 2019

(65) Prior Publication Data

US 2020/0309433 A1 Oct. 1, 2020

(51) Int. Cl.

| | |
|---|---|
| ***F25B 49/02*** | (2006.01) |
| ***F25B 40/02*** | (2006.01) |
| ***F25B 13/00*** | (2006.01) |

(52) U.S. Cl.

CPC ..... *F25B 49/02* (2013.01); *F25B 40/02* (2013.01); *F25B 13/00* (2013.01); *F25B 2400/0417* (2013.01); *F25B 2400/13* (2013.01)

(58) Field of Classification Search

CPC ..... F25B 2400/0417; F25B 6/04

See application file for complete search history.

(56) References Cited

U.S. PATENT DOCUMENTS

| | | | | |
|---|---|---|---|---|
| 10,723,203 | B2 * | 7/2020 | Kato | B60H 1/32284 |
| 2015/0345846 | A1 | 12/2015 | Kopko et al. | |
| 2019/0017730 | A1 * | 1/2019 | Matsukura | F25B 49/022 |

FOREIGN PATENT DOCUMENTS

| | | | |
|---|---|---|---|
| CN | 204854060 | U | 12/2015 |
| WO | 2017000279 | A1 | 1/2017 |

* cited by examiner

*Primary Examiner* — Christopher R Zerphey

(74) *Attorney, Agent, or Firm* — Hamre, Schumann, Mueller & Larson, P.C.

(57) ABSTRACT

Methods and systems for controlling working fluid flow in a heating, ventilation, air conditioning and refrigeration (HVACR) unit for an HVACR system are disclosed. The unit includes a compressor having a motor and a drive. The unit also includes a condenser fluidly connected to the compressor. A subcooler is located downstream of the condenser. The unit further includes an evaporator fluidly connected to the condenser. Also the unit includes a controller. The unit also includes a bypass assembly connected to the condenser. The bypass assembly includes a bypass flow control device and a bypass fluid line controlled by the bypass flow control device. When a heat recovery demand is detected by the controller, the controller is configured to open the bypass flow control device to allow a first portion of working fluid to bypass the condenser or the subcooler.

17 Claims, 5 Drawing Sheets

METHODS AND SYSTEMS FOR CONTROLLING WORKING FLUID IN HVACR SYSTEMS

FIELD

This disclosure relates generally to working fluid flow control for heating, ventilation, air-conditioning and refrigeration ("HVACR") systems. More specifically, the disclosure relates to methods and systems for controlling working fluid flow in an HVACR unit for an HVACR system.

BACKGROUND

In HVACR system(s), fan(s) such as condenser fans are used in chillers (e.g., air cooled chillers) to reject heat from refrigerant flowing through the system(s). Heat can be rejected from the refrigerant to, for example, some other fluid such as air or water, or to ambient. With a heat recovery system, energy can be recovered from the exhaust fluid flow to the intake fluid flow. Heat recovery can typically be achieved via a heat exchanger to recover energy simultaneously both for temperature (sensible heat) and for hygrometry (latent heat).

SUMMARY

This disclosure relates generally to working fluid flow control for heating, ventilation, air-conditioning and refrigeration ("HVACR") systems. More specifically, the disclosure relates to methods and systems for controlling working fluid flow in an HVACR unit for an HVACR system.

In an embodiment, an HVACR unit for an HVACR system is disclosed. The unit includes a compressor that can have a motor and a drive. The unit also includes a condenser fluidly connected to the compressor. A subcooler is located downstream of the condenser. The unit further includes an evaporator fluidly connected to the subcooler. Also the unit includes a controller. The unit also includes a bypass assembly connected to the condenser. The bypass assembly includes a bypass flow control device and a bypass fluid line controlled by the bypass flow control device. When a heat recovery demand is detected by the controller, the controller is configured to open the bypass flow control device to allow a first portion of working fluid to bypass the condenser or the subcooler.

In an embodiment, a method for controlling working fluid flow in an HVACR unit for an HVACR system is disclosed. The method includes detecting, by a controller, a heat recovery demand. The method also includes when the heat recovery demand is detected, opening a bypass flow control device to allow a first portion of working fluid to bypass a condenser or a subcooler. The method further includes when the heat recovery demand is not detected, opening the bypass flow control device to allow a second portion of working fluid to bypass the condenser or the subcooler.

Other features and aspects will become apparent by consideration of the following detailed description and accompanying drawings.

BRIEF DESCRIPTION OF THE DRAWINGS

References are made to the accompanying drawings that form a part of this disclosure and which illustrate the embodiments in which systems and methods described in this specification can be practiced.

Like reference numbers represent like parts throughout.

DETAILED DESCRIPTION

This disclosure relates generally to working fluid flow control for heating, ventilation, air-conditioning and refrigeration ("HVACR") systems. More specifically, the disclosure relates to methods and systems for controlling working fluid flow in an HVACR unit for an HVACR system. In an embodiment, the working fluid can be a heat transfer fluid such as refrigerant, water, glycol, or the like. It will be appreciated that in the embodiments disclosed herein, the term "heat recovery" includes "total heat recovery" which can typically be achieved via a heat exchanger to recover energy simultaneously both for temperature (sensible heat) and for hygrometry (latent heat).

Figure 1:
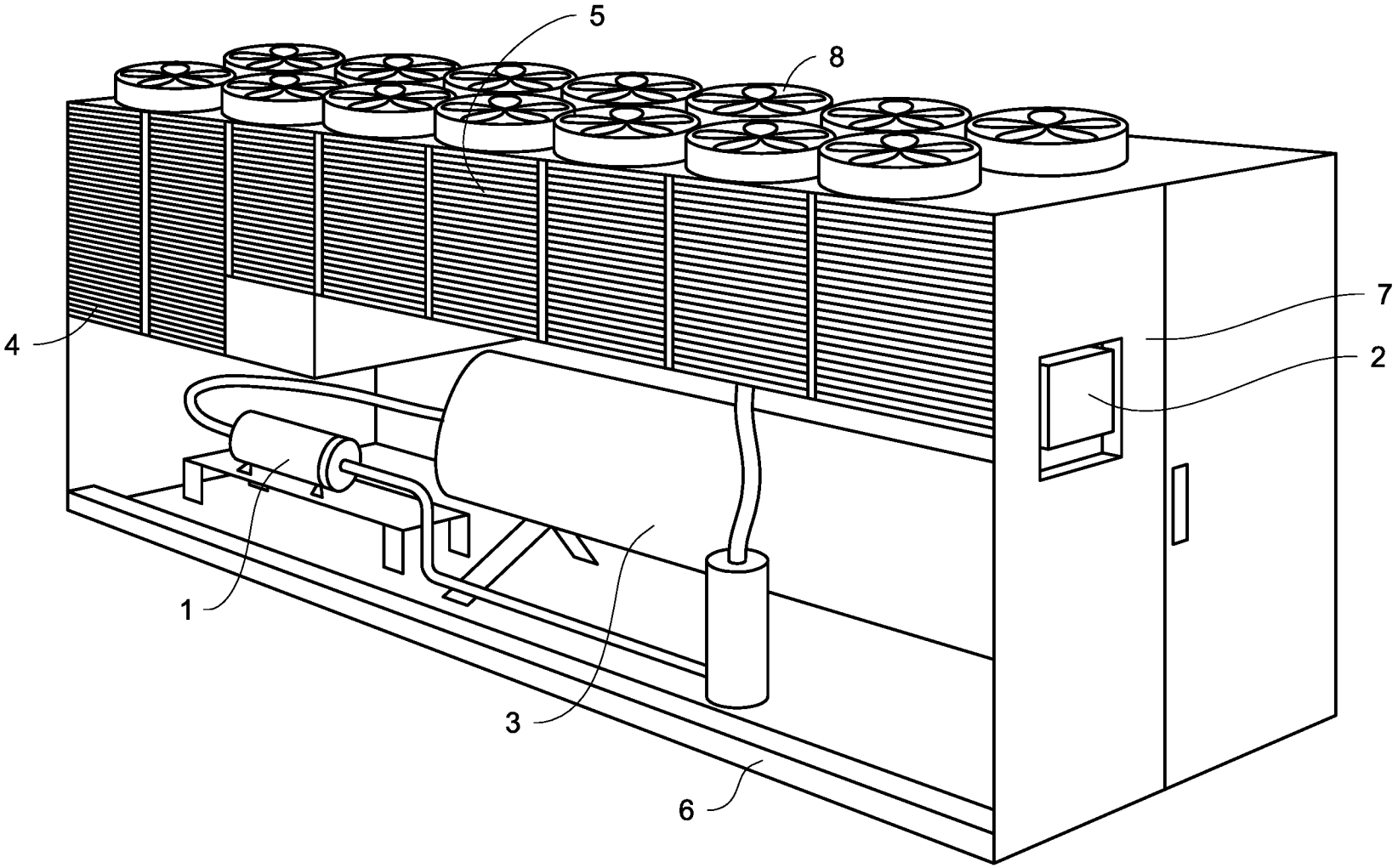
FIG. 1 illustrates a schematic view of a chiller in an HVACR system, according to an embodiment.

FIG. 1 shows a schematic view of a chiller in an HVACR system. FIG. 1 shows an embodiment of a chiller (such as an air cooled chiller) that has a compressor 1, an evaporator 3, a condenser 4 with air coil 5 and fans 8, and a control unit 2 and panel 7. It will be appreciated that the compressor 1 can be a variable speed compressor or a variable load compressor and/or one of the multiple fixed speed compressors that can be staged on/off, and that the fans 8 can be variable speed fan(s) and/or fan(s) with a multiple number of fan stages or discrete steps. The condenser 4 and its air coil 5 in the embodiment shown are one example of an air cooled condenser, however it will be appreciated that the specific condenser 4/coil 5 combination shown is merely exemplary. The chiller can be considered a single unit within the HVACR system and be supported by a frame 6 for example. It will be appreciated that the specific configuration shown in FIG. 1 is merely exemplary, as other chiller designs, layouts, and specific configurations may be employed. For example, the chiller of FIG. 1 can be a chiller with "W" shaped coils; however, it will be appreciated that other coil types may be used, such as for example multiple "V" shaped coils or more than one circuit employing multiple compressors, evaporators, condensers.

Figure 2:
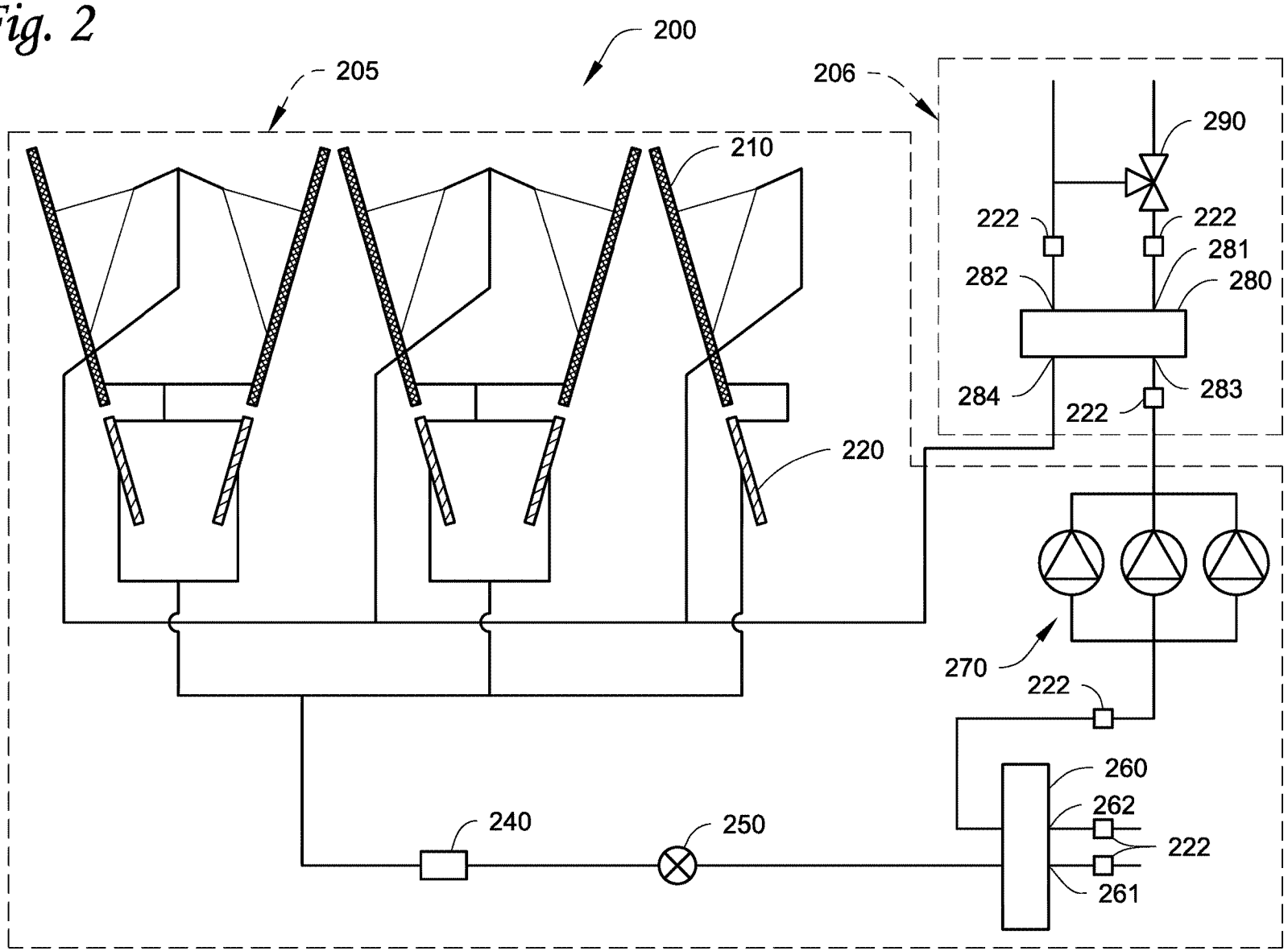
FIG. 2 is a schematic diagram of a refrigerant circuit, according to an embodiment.

FIG. 2 is a schematic diagram of a refrigerant circuit 200, according to an embodiment. As shown in FIG. 2, the refrigerant circuit 200 includes chiller 205 (such as the chiller of FIG. 1). The refrigerant circuit 200 also includes a heat recovery system 206. The chiller 205 includes a condenser unit. The condenser unit can be, for example, the condenser 4 of FIG. 1. The condenser unit includes a condenser portion (referred to as "condenser") 210. The condenser unit also includes a subcooler portion (referred to as "subcooler") 220. The subcooler 220 is in fluid communication with the condenser 210. The subcooler 220 is disposed downstream of the condenser 210 with respect to the working fluid flow. In an embodiment, the chiller 205 also includes a filter 240. The filter 240 is in fluid communication with the condenser unit. In an embodiment, the filter 240 is located downstream of the condenser unit with respect to the working fluid flow. The chiller 205 further includes an expansion device 250. In an embodiment, the expansion device 250 can be but is not limited to for example an expansion valve, orifice, expander, or the like. The expansion device 250 is in fluid communication with the filter 240. In an embodiment, the expansion device 250 is located downstream of the filter 240 with respect to the working fluid flow.

Also the chiller 205 includes an evaporator 260. The evaporator 260 is in fluid communication with the expansion device 250. In an embodiment, the evaporator 260 is located downstream of the expansion device 250 with respect to the working fluid flow. Further, the chiller 205 includes a compressor 270. The compressor 270 is in fluid communication with the evaporator 260. In an embodiment, the compressor 270 is located downstream of the evaporator 260 with respect to the working fluid flow.

The heat recovery system 206 includes a heat exchanger 280. In an embodiment, the heat exchanger 280 can be a heat recovery heat exchanger. In an embodiment, the heat exchanger 280 can be a brazed plate heat exchanger. The heat exchanger 280 is in fluid communication with the compressor 270. In an embodiment, the heat exchanger 280 is located downstream of the compressor 270 with respect to the working fluid flow. The condenser unit is in fluid communication with the heat exchanger 280. In an embodiment, the condenser unit is located downstream of the heat exchanger 280 with respect to the working fluid flow. It will be appreciated that in this embodiment, the heat exchanger 280 connects in series with the chiller 205.

It will be appreciated that the refrigerant circuit 200 is an example and can be modified to include additional components. For example, in an embodiment, the refrigerant circuit 200 can include other components such as, but not limited to, an economizer heat exchanger, one or more flow control devices, a receiver tank, a dryer, a suction-liquid heat exchanger, or the like. The refrigerant circuit 200 can generally be applied in a variety of systems used to control an environmental condition (e.g., temperature, humidity, air quality, or the like) in a space (generally referred to as a conditioned space). Examples of such systems include, but are not limited to, HVACR systems, transport refrigeration systems, or the like. In an embodiment, a HVACR system can be a rooftop unit or a heat pump air-conditioning unit. In an embodiment, the refrigerant circuit 200 can be configured to be a cooling system (e.g., an air conditioning system) capable of operating in a cooling mode. In an embodiment, the refrigerant circuit 200 can be configured to be a heat pump system that can operate in both a cooling mode and a heating/defrost mode. The refrigerant circuit 200 can be configured to heat or cool a liquid process fluid (e.g., a heat transfer fluid or medium (e.g., a liquid such as, but not limited to, water or the like)), in which case the refrigerant circuit 200 may be generally representative of a liquid chiller system. The refrigerant circuit 200 can alternatively be configured to heat or cool a gaseous process fluid (e.g., a heat transfer medium or fluid (e.g., a gas such as, but not limited to, air or the like)), in which case the refrigerant circuit 200 may be generally representative of an air conditioner or heat pump.

In operation, the compressor 270 compresses a working fluid from a relatively lower pressure gas to a relatively higher-pressure gas. The relatively higher-pressure gas is also at a relatively higher temperature, which is discharged from the compressor 270. It will be appreciated that at or near the working fluid inlet and/or the working fluid outlet of the compressor 270, there can be sensors 222 (such as temperature sensor, pressure sensor, or the like) that can sense (or measure) the properties (e.g., temperature, pressure, or the like) of the gas (e.g., the working fluid). The sensed (or measured) data can be sent to a controller (such as the controller 2 of FIG. 1). Typically the gas discharged from the compressor flows through the condenser. In a chiller (such as an air cooled chiller) with a heat recovery system, such as the refrigerant circuit 200, the gas discharged from the compressor 270 flows through the heat exchanger 280 (e.g., by entering the working fluid inlet 283 of the heat exchanger 280 and leaving the working fluid outlet 284 of the heat exchanger 280). The working fluid flows through the heat exchanger 280 and rejects heat to the process fluid (e.g., water, air, etc.), thereby cooling the working fluid.

The heat exchanger 280 can be a heat recovery heat exchanger such as a total heat recovery heat exchanger. It will be appreciated that heat recovery can refer to the process of reclaiming a portion of the energy (such as heat) wasted by the use of, for example, HVACR systems. It will also be appreciated that total heat recovery heat exchanger can be used as a way to recover energy (such as heat) simultaneously both for temperature (sensible heat) and for hygrometry (latent heat). It will further be appreciated that compared with a total heat recovery heat exchanger, a partial heat recovery exchanger can be a heat recovery exchanger when only a portion of the working fluid passes through heat recovery exchanger and/or when there is no latent heat recovery.

It will be appreciated that at or near the process fluid inlet 281 of the heat exchanger 280 and/or the process fluid outlet 282 of the heat exchanger 280, there can be one or more sensors 222 (such as temperature sensor, pressure sensor, flow sensor, or the like) that can sense (or measure) one of more properties (e.g., temperature, pressure, flow, or the like) of the process fluid. The sensed (or measured) data can be sent to a controller (such as the controller 2 of FIG. 1). It will also be appreciated that fluid inlet 281 can be the process fluid outlet, and fluid outlet 282 can be the process fluid inlet. It will be appreciated that the "heat recovery leaving process fluid temperature" can refer to the temperature of the process fluid leaving the heat exchanger 280 (e.g., a heat recovery heat exchanger), which can be sensed or measured via the temperature sensor at or near the process fluid outlet 282. It will also be appreciated that the "heat recovery entering process fluid temperature" can refer to the temperature of the process fluid entering the heat exchanger 280 (e.g., a heat recovery heat exchanger), which can be sensed or measured via the sensor 222 at or near the process fluid inlet 281, which may be a temperature sensor or other suitable sensor from which temperature can be inferred.

The heat recovery system 206 also includes a flow control device (such as a three-way valve) 290. The flow control device 290 is disposed on the process fluid line (e.g., pipe, tube, or the like) to control the flow of the process fluid. The flow control device 290 is disposed in the process fluid loop and is controlled by a controller (such as the controller 2 of FIG. 1) to produce a desired process fluid temperature. The refrigerant circuit 200 can include an ambient temperature sensor (not shown) that senses or measures the ambient temperature. The sensed or measured ambient temperature can be sent to the controller (such as the controller 2 of FIG. 1).

Typically, the working fluid flowing through the heat exchanger 280 and leaving the working fluid outlet 284 of the heat exchanger 280 can be a gas/liquid mixed state. It will be appreciated that a degree of "dryness" of the working fluid can refer to a degree to which the working fluid is in a gas state. For example, a higher degree of dryness indicates that the working fluid is relatively more in a gas state and less in a liquid state.

The working fluid leaving the working fluid outlet 284 of the heat exchanger 280 flows through the condenser unit. The working fluid flows through the condenser unit and rejects heat to the process fluid (e.g., water, air, etc.), thereby cooling the working fluid. The cooled working fluid, which is now in a liquid form, flows to the filter 240. It will be appreciated that in an embodiment where the refrigerant circuit 200 does not have a filter, and the cooled working fluid from the condenser unit flows to the expansion device 250.

It will be appreciated that in an embodiment, the condenser unit can include only the condenser 210, and there is no subcooler 220. In an embodiment in which the condenser unit includes a subcooler 220, the liquid working fluid can flow through the subcooler 220 prior to flowing to the filter 240 (or to the expansion device 250 in an embodiment where the refrigerant circuit 200 does not have a filter). In the subcooler 220, the working fluid may be further subcooled. The subcooler 220 is disposed downstream of the condenser 210 with respect to the working fluid flow (e.g., the working fluid flows from the working fluid outlet of the condenser 210 to the working fluid inlet of the subcooler 220).

In an embodiment, the condenser unit can be a microchannel heat exchanger. The condenser unit can include a plurality of flat tubes with fins located between the flat tubes extending between a plurality of headers. A microchannel heat exchanger typically includes an inlet header, an outlet header, and a plurality of flat tubes connecting to and communicating with the headers. Each of the flat tubes has microchannels or small pathways for working fluid (gas or liquid) to pass through. The working principles of microchannel heat exchangers are that working fluid enters the inlet header via an inlet of the inlet header, then the working fluid enters the flat tubes having microchannels, and the working fluid conducts heat exchange with a process fluid external to the flat tubes (e.g., air) to provide cooling or heating when the working fluid flows within the flat tubes.

In an embodiment, the condenser unit can be made of multiple coils, each having microchannel tubes and having appropriate inlet and outlet headers. In an embodiment, the microchannel tubes of a coil may have fins disposed between the tubes. A working fluid enters the inlet header, and the plurality of tubes conveys the working fluid to the outlet header. Fins are thermally conductive to promote heat transfer between the working fluid flowing through tubes (which are also thermally conductive) and a process fluid (e.g., air) flowing across the external surfaces of fins and tubes. A fan, blower or some other means (e.g., 8 in FIG. 1) can be used for forcing air or some other process fluid across the external surfaces of the condenser unit.

It will be appreciated that in another embodiment, the condenser unit can have round tube and fin coil(s).

The filter 240 can be filter driers. It will be appreciated that filter driers can be devices used in, for example, a HVACR system, that are a combination of filter and drier (or dryer). A filter can be used to remove particle such as dirt, metal, unwanted debris material, etc. from entering the working fluid flow. The working fluid flowing through the filter 240 flows to the expansion device 250.

The expansion device 250 reduces the pressure of the working fluid. As a result, a portion of the working fluid is converted to a gaseous form. The working fluid, which is now in a mixed liquid and gaseous form flows to the evaporator 260. The working fluid flows through the evaporator 260 and absorbs heat from a process fluid (e.g., a heat transfer medium (e.g., water, glycol, air, etc.)) heating the working fluid, and converting it to a gaseous form. The gaseous working fluid then returns to the compressor 270. The above-described process continues while the refrigerant circuit 200 is operating, for example, in a cooling mode (e.g., while the compressor 270 is enabled).

It will be appreciated that at or near the working fluid outlet of the evaporator 260 (and/or at or near the working fluid inlet of the compressor 270, there can be one or more sensors 222 (such as temperature sensor, pressure sensor, or the like) that can sense (or measure) one or more properties (e.g., temperature, pressure, or the like) of the working fluid. The sensed (or measured) data can be sent to a controller (such as the controller 2 of FIG. 1). It will also be appreciated that at or near the process fluid inlet 261 of the evaporator 260 (and/or at or near the process fluid outlet 262 of the evaporator 260), there can be one or more sensors 222 (such as temperature sensor, pressure sensor, flow sensor, or the like) that can sense (or measure) one or more properties (e.g., temperature, pressure, flow, or the like) of the process fluid. The sensed (or measured) data can be sent to a controller (such as the controller 2 of FIG. 1).

It will also be appreciated that in FIG. 2, the heat recovery system 206 can be a total heat recovery system. In an embodiment, the chiller 205 connects in series with the heat recovery system 206. The heat recovery system 206 is disposed upstream of the condenser unit of the chiller 205 with respect to the working fluid flow when heat recovery is demanded (e.g., in a heat recovery mode). Compared with a parallel designed heat recovery chiller, a chiller with series heat recovery system can save cost and simplify the design. In a chiller with a heat recovery system connected in series, a desired process fluid (e.g. water for heat exchanger 280) temperature can be achieved by modulating process fluid (e.g., air for the condenser unit) flow entering the condenser unit and by controlling the flow control device 290 in the process fluid loop. In such an embodiment, if alternating current condenser fans are used, air flow can be modulated by starting and/or stopping the fans; if direct current condenser fans are used, air flow can be modulated by adjusting the fan speed.

It will be appreciated that in a chiller with a heat recovery system connected in series, heat exchanger for heat recovery mode is typically designed with heat exchanging area as small as possible. Such design can help to avoid adding too much working fluid charge into the system, and help to achieve steady running of the system in the heat recovery mode. The embodiments disclosed herein require less working fluid charge addition to maintain sufficient subcooling for a chiller with series heat recovery system. The embodiments disclosed herein can also support less volume heat recovery receiver.

During a heat recovery mode, the degree of dryness of the working fluid can be high (e.g., the working fluid can be more in a gas state and less in a liquid state) at the working fluid outlet 284 of the heat recovery heat exchanger. Condenser fans (e.g., fan modules disposed on top of the condenser) can be commanded to cool down the temperature of the condenser (e.g., finned tube type or microchannel type) to a predetermined margin exceeding the user demanded process fluid (e.g., water) temperature. As such, the user can get the desired recovered heat by keeping the predetermined margin at the outlet of the condenser. The predetermined margin can be, for example, at or about 3° C. to at or about 5° C. The high degree of dryness of the working fluid flowing out of the heat recovery heat exchanger can be further condensed to a liquid state in the condenser.

A heat recovery system typically can reclaim about 80% condensing heat (including the sensible heat and a part of latent heat). More circuits in the subcooler can reduce the mass flow in each circuit and the corresponding working fluid pressure drop such that there can be less losses of subcooling through the subcooler. During heat recovery mode, due to less process fluid (e.g., air for the condenser) flow and some redundant circuits in the subcooler, more pressure drop can be encountered and subcooling of the working fluid can decrease or even be lost, which can result in starving of the evaporator and a decrease in the cooling (heat recovery) capacity. When the ambient temperature is higher than user demanded process fluid (e.g., water for the heat recovery heat exchanger) temperature, the condenser fan can decrease the amount of air flow. The decreasing of the amount of air flow can keep the condensing temperature higher to offset the subcooling loss. The subcooling loss can be, for example, due to excessive pressure drop. Excessive pressure drop can occur, for example, when the working fluid flows across the condenser after the initial cooling down in the heat recovery heat exchanger. However, the working fluid can still vaporize (e.g., flash) depending on the difference (e.g., at or about one Celsius degree) between the ambient temperature and the user demanded process fluid (e.g., water for the heat recovery heat exchanger) temperature. Working fluid pressure drop and working fluid vaporizing can be reduced by adding a bypass assembly to the refrigerant circuit. The embodiments disclosed herein can provide low maintenance, low cost, and/or high reliable operation. The design can provide a mechanical solution (e.g., no associated component needs to be updated) to provide as small as at or about 1° C. temperature difference between the ambient temperature and the user demanded process fluid (e.g., hot water) temperature.

Figure 3:
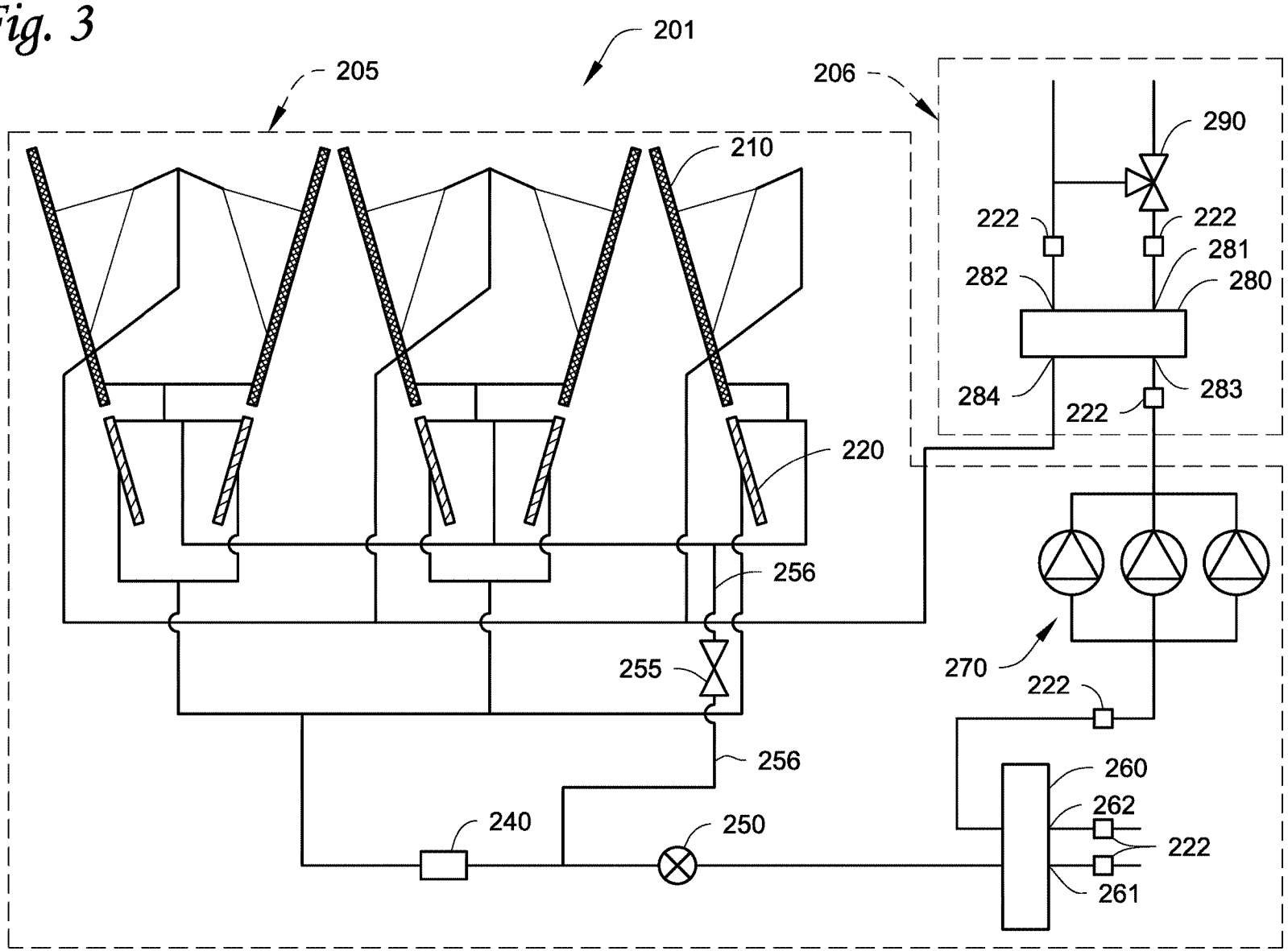
FIG. 3 is a schematic diagram of a refrigerant circuit having a bypass assembly, according to an embodiment.

FIG. 3 is a schematic diagram of a refrigerant circuit 201 having a bypass assembly, according to an embodiment. It will be appreciated that the structure and function of the elements of FIG. 3 are similar to the structure and function of the elements of FIG. 2, except as discussed below.

The refrigerant circuit 201 includes a bypass assembly. The bypass assembly includes a bypass fluid line (e.g., pipe, tube, or the like) 256. It will be appreciated that the bypass fluid line 256 can be more than one fluid line. The bypass assembly also includes a bypass flow control device 255. The bypass flow control device 255 can be but is not limited to, for example, a valve, a solenoid valve, or a stepping motor valve. A first end of the bypass fluid line 256 connects to and is in fluid communication with the working fluid outlet of the condenser 210. In an embodiment, the first end of the bypass fluid line 256 is disposed between the working fluid outlet of the condenser 210 and the working fluid inlet of the subcooler 220. In an embodiment, the first end of the bypass fluid line 256 is disposed downstream of the working fluid outlet of the condenser 210 and upstream of the working fluid inlet of the subcooler 220.

A second end of the bypass fluid line 256 connects to and is in fluid communication with the working fluid inlet of the expansion device 250. In an embodiment, the second end of the bypass fluid line 256 is disposed between the working fluid outlet of the filter 240 and the working fluid inlet of the expansion device 250. In an embodiment, the second end of the bypass fluid line 256 is disposed downstream of the working fluid outlet of the filter 240 and upstream of the working fluid inlet of the expansion device 250.

In an embodiment, the bypass flow control device 255 is disposed on the bypass fluid line 256 and is controlled by a controller (such as the controller 2 of FIG. 1) to control the working fluid flow in the bypass fluid line 256.

In operation, when the bypass flow control device 255 is controlled to be open, at least a portion of the working fluid can bypass the subcooler 220 (as well as the filter 240) and flow into the working fluid inlet of the expansion device 250. It will be appreciated that when the bypass flow control device 255 is controlled to be open, the amount (portion) of the working fluid can be controlled by the controller (such as the controller 2 of FIG. 1). The amount (portion) can range from 0% to 100%, for example, at or about 10%, at or about 50%, more than 50%, at or about 90%, at or about 100% of the total working fluid flowing through the corresponding inlets/outlet/fluid line(s). When the bypass flow control device 255 is controlled to be closed, the working fluid does not bypass the subcooler 220 (as well as the filter 240).

In operation, when a heat recovery is demanded, the controller (such as the controller 2 of FIG. 1) can control the bypass flow control device 255 to open to allow a first portion (e.g., at or about 50% or more than 50%) of the working fluid to flow from the working fluid outlet of the condenser 210 to the working fluid inlet of the expansion device 250. Under such condition, a first portion (e.g., at or about 50% or more than 50%) of the working fluid bypasses the subcooler 220. The condition "a heat recovery is demanded" can be met when the controller determines that the heat recovery leaving process fluid temperature (e.g., the temperature of the process fluid (such as water) leaving the heat recovery heat exchanger 280) is greater than the heat recovery entering process fluid temperature (e.g., the temperature of the process fluid (such as water) entering the heat recovery heat exchanger 280). The condition "a heat recovery is demanded" can also be met when a hot process fluid (such as hot water) flow (e.g., in the process fluid loop of the heat recovery system) is detected by the controller.

When a heat recovery is demanded, the controller (such as the controller 2 of FIG. 1) can control the bypass flow control device 255 to open to allow a first portion (e.g., at or about 50% or more than 50%) of the working fluid to flow from the working fluid outlet of the condenser 210 to the working fluid inlet of the expansion device 250. An advantage of controlling the bypass flow control device 255 to a certain opening is to reduce pressure drop across the subcooler 220 with a portion of the working fluid bypassing the subcooler 220. Such design can save as much subcooling as possible (e.g., by avoid subcooling loss due to excessive pressure drop), in order to improve the stability of the expansion device control and to recover the cooling capacity and the heat recovery capacity.

When there is no heat recovery demand (e.g., the heat recovery leaving process fluid temperature is equal to the heat recovery entering process fluid temperature, or a hot process fluid flow is not detected by the controller), the refrigerant circuit 201 operates in a cooling only mode, the controller (such as the controller 2 of FIG. 1) can control the bypass flow control device 255 to open to allow a second portion (e.g., at or about 10% or less than 10%) of the working fluid to flow from the working fluid outlet of the condenser 210 to the working fluid inlet of the expansion device 250 to mitigate lubricant (e.g., oil) retention risk in the condenser 210 and in the subcooler 220.

Figure 4:
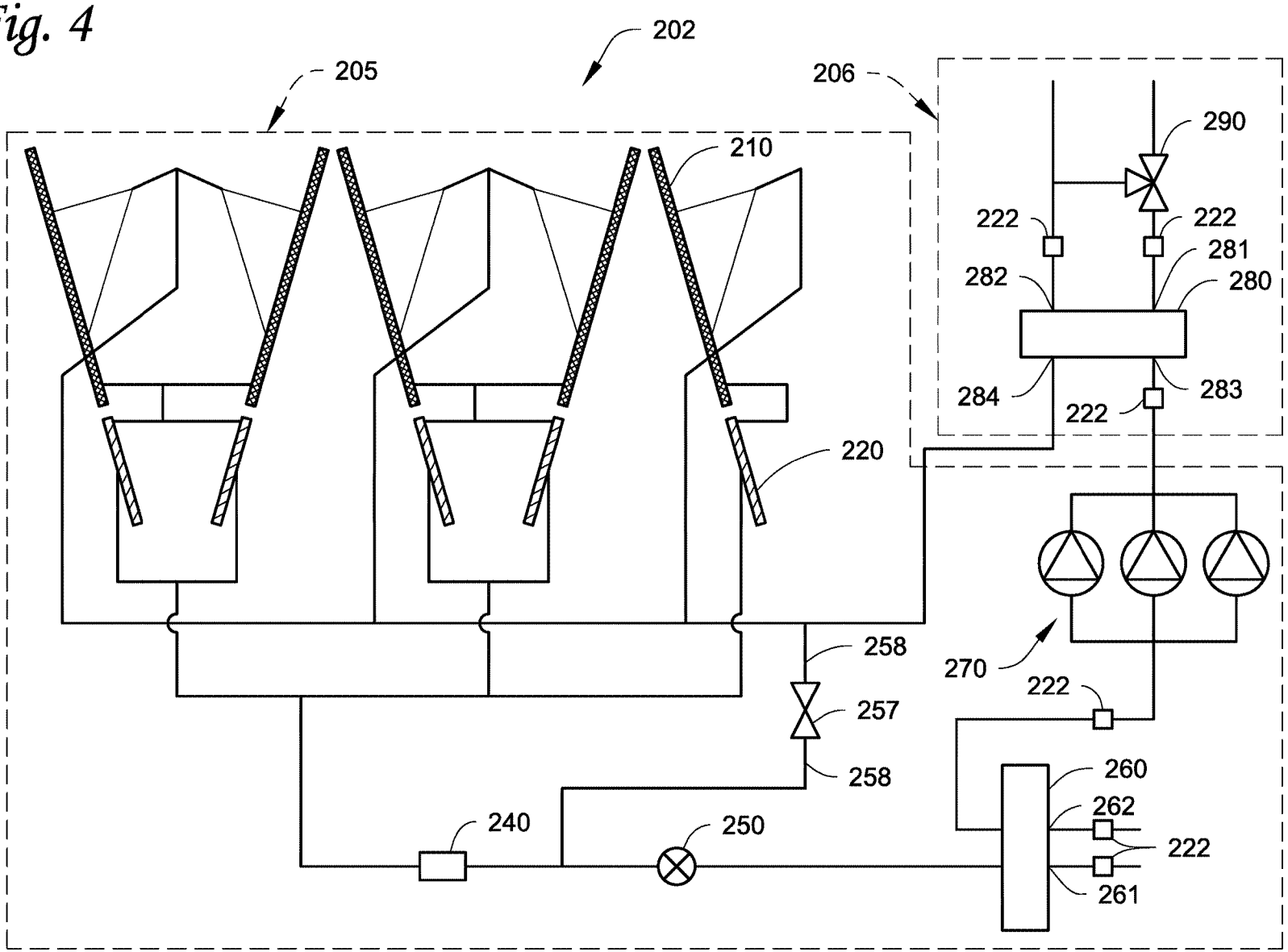
FIG. 4 is a schematic diagram of a refrigerant circuit having a bypass assembly, according to an embodiment.

FIG. 4 is a schematic diagram of a refrigerant circuit 202 having a bypass assembly, according to another embodiment. It will be appreciated that the structure and function of the elements of FIG. 4 are similar to the structure and function of the elements of FIG. 2, except as discussed below.

The refrigerant circuit 202 includes a bypass assembly. The bypass assembly includes a bypass fluid line (e.g., pipe, tube, or the like) 258. It will be appreciated that the bypass fluid line 258 can be more than one fluid line. The bypass assembly also includes a bypass flow control device 257. The bypass flow control device 257 can be but is not limited to, for example, a valve, a solenoid valve, or a stepping motor valve. A first end of the bypass fluid line 258 connects to and is in fluid communication with the working fluid inlet of the condenser 210. In an embodiment, the first end of the bypass fluid line 258 is disposed between the working fluid inlet of the condenser 210 and the working fluid outlet of the heat exchanger 280. In an embodiment, the first end of the bypass fluid line 258 is disposed downstream of the working fluid outlet of the heat exchanger 280 and upstream of the working fluid inlet of the condenser 210.

A second end of the bypass fluid line 258 connects to and is in fluid communication with the working fluid inlet of the expansion device 250. In an embodiment, the second end of the bypass fluid line 258 is disposed between the working fluid outlet of the filter 240 and the working fluid inlet of the expansion device 250. In an embodiment, the second end of the bypass fluid line 256 is disposed downstream of the working fluid outlet of the filter 240 and upstream of the working fluid inlet of the expansion device 250.

The bypass flow control device 257 is disposed on the bypass fluid line 258 and is controlled by a controller (such as the controller 2 of FIG. 1) to control the working fluid flow in the bypass fluid line 258.

In operation, when the bypass flow control device 257 is controlled to be open, at least a portion of the working fluid can bypass the condenser 210 (including the subcooler 220 if there is one, and bypass the filter 240) and flow into the working fluid inlet of the expansion device 250. It will be appreciated that when the bypass flow control device 257 is controlled to be open, the amount (portion) of the working fluid can be controlled by the controller (such as the controller 2 of FIG. 1). The amount (portion) can range from 0% to 100%, for example, at or about 10%, at or about 50%, more than 50%, at or about 90%, at or about 100% of the total working fluid flowing through the corresponding inlets/outlet/fluid line(s). When the bypass flow control device 257 is controlled to be closed, the working fluid does not bypass the condenser 210 (including the subcooler 220 if there is one, and does not bypass the filter 240).

In operation, when a heat recovery is demanded, the controller (such as the controller 2 of FIG. 1) can control the bypass flow control device 257 to open to allow a first portion (e.g., at or about 50% or more than 50%) of the working fluid to flow from the working fluid outlet of the heat exchanger 280 (or the working fluid inlet of the condenser 210) to the working fluid inlet of the expansion device 250. Under such condition, a first portion (e.g., at or about 50% or more than 50%) of the working fluid bypasses the condenser 210 (and the subcooler 220). The condition "a heat recovery is demanded" can be met when the controller determines that the heat recovery leaving process fluid temperature (e.g., the temperature of the process fluid (such as water) leaving the heat recovery heat exchanger 280) is greater than the heat recovery entering process fluid temperature (e.g., the temperature of the process fluid (such as water) entering the heat recovery heat exchanger 280). The condition "a heat recovery is demanded" can also be met when a hot process fluid (such as hot water) flow (e.g., in the process fluid loop of the heat recovery system) is detected by the controller.

When a heat recovery is demanded, the controller (such as the controller 2 of FIG. 1) can control the bypass flow control device 257 to open to allow a first portion (e.g., at or about 50% or more than 50%) of the working fluid to flow from the working fluid outlet of the heat exchanger 280 (or the working fluid inlet of the condenser 210) to the working fluid inlet of the expansion device 250.

An advantage of controlling the bypass flow control device 257 to a certain opening is to prevent working fluid pressure drop or heat loss through the condenser 210 due to vaporization of the working fluid when the ambient temperature is higher than the working fluid's saturated temperature, to prevent excessive pressure drop in the subcooler 220, and to improve the control of the expansion device 250.

It will be appreciated that when the ambient temperature is greater than the heat recovery leaving process fluid temperature, the system does not reject (or recover) heat because the condenser behaves as an evaporator under such condition.

When there is no heat recovery demand (e.g., the heat recovery leaving process fluid temperature is equal to the heat recovery entering process fluid temperature, or a hot process fluid flow is not detected by the controller), the refrigerant circuit 202 operates in a cooling only mode, the controller (such as the controller 2 of FIG. 1) can control the bypass flow control device 257 to open to allow a second portion (e.g., at or about 10% or less than 10%) of the working fluid to flow from the working fluid outlet of the heat exchanger 280 (or the working fluid inlet of the condenser 210) to the working fluid inlet of the expansion device 250 to mitigate lubricant (e.g., oil) retention risk in condenser 210 (and in the subcooler 220 if there is one).

Regarding FIGS. 3 and 4, when there is heat recovery demand (or needs), the controller is configured to open the bypass flow control device (255 and/or 257) to bypass the working fluid flow from the condenser unit or the subcooler 220, which can reduce working fluid pressure drop, reduce working fluid vaporizing, reduce subcooling loss, and enhance the control stability of the expansion device, which in turn improves the system cooling capacity and the heat recovery capability and improves the cooling (and/or heat recovery) efficiency. As such, larger heat recovery heat exchanger (e.g., heat recovery heat exchanger with larger heat exchanging area) can be used in the system to boost the heat recovery capacity rate (e.g., to at or about or above 90%), condenser fan process fluid (e.g., air) flow and power can be decreased, and chiller efficiency can be improved. It will be appreciated that the condenser unit can be a microchannel condenser or a round tube and fin coil condenser, or any suitable condenser.

The embodiments disclosed herein can minimize working fluid pressure drop across the condenser (and the subcooler) to recover subcooling entering the expansion device and enhance the stability of control of the expansion device. The embodiments disclosed herein can also enable the use of larger heat exchanging area for heat recovery to reclaim more condenser heat (e.g., to at or about or above 90% of the condenser heat) with less fan power consumption, without redesigning the circuitry of the subcooler coil to account for excessive working fluid pressure drop during heat recovery mode. The embodiments disclosed herein can support fewer condenser fans running (or slower fan speed) and/or less air flow in simultaneous heat recovery and cooling mode, and the refrigeration circuit can sustain more subcooling loss to improve the chiller efficiency such as cooling EER (energy efficiency ratio) and/or heating COP (coefficient of performance).

Figure 5:
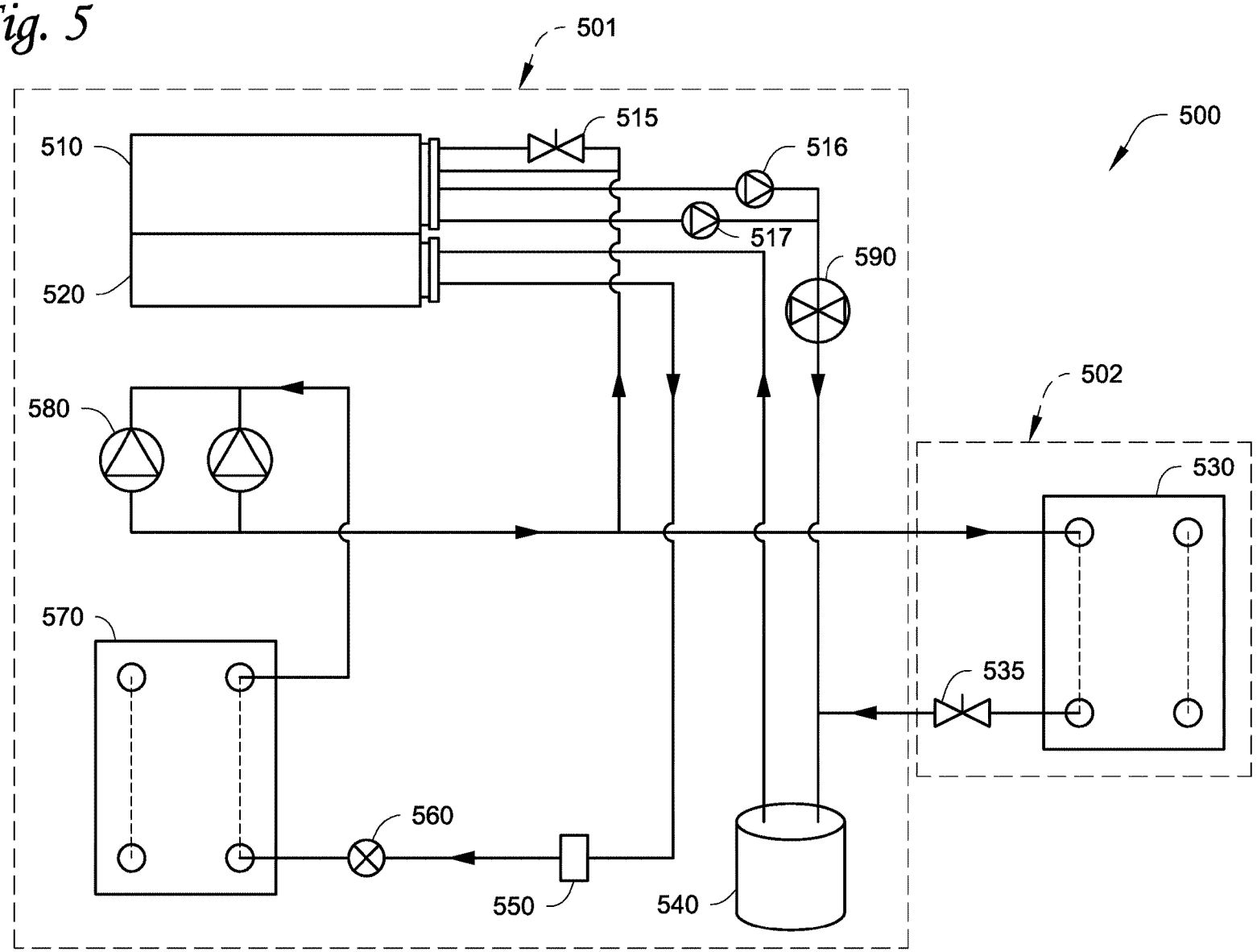
FIG. 5 is a schematic diagram of a refrigerant circuit with split condenser, according to yet an embodiment.

FIG. 5 is a schematic diagram of a refrigerant circuit 500 with split condenser, according to yet another embodiment. In FIG. 5, the refrigerant circuit 500 with "split" condenser (see details below) is disclosed. In an embodiment, the refrigerant circuit 500 can include a chiller 501 having a cooling mode and a heating mode (e.g., with heat recovery). The refrigerant circuit 500 can include a heat recovery heat exchanger 530 arranged in parallel with a condenser (e.g., an air cooled condenser). The parallel heat recovery arrangement can provide better efficiency than a cooling only chiller.

In a heating mode with heat recovery, typically additional working fluid charge is needed. The additional working fluid charge typically fills the condenser during the heat recovery operation. In the cooling mode, the additional working fluid charge typically stays in the receiver. The additional working fluid charge can complicate the flexibility and smooth operation of the heat recovery system and add cost. Embodiments disclosed herein can reduce working fluid charge and/or prevent working fluid charge from accumulating in the condenser, and achieve the required heating without interrupting the cooling capacity of the chiller.

As shown in FIG. 5, the refrigerant circuit 500 includes a chiller 501. The chiller 501 includes a condenser unit (510 and 520). The condenser unit (510 and 520) can be, for example, the condenser 4 of FIG. 1. The condenser unit (510 and 520) includes a condenser portion (referred to as condenser) 510. The condenser unit (510 and 520) also includes a subcooler portion (referred to as subcooler) 520. The subcooler 520 is in fluid communication with the condenser 510. The subcooler 520 is disposed downstream of the condenser 510 with respect to the working fluid flow.

The refrigerant circuit 500 also includes a heat recovery system 502. The heat recovery system 502 includes a heat recovery heat exchanger 530 (e.g., a heat recovery condenser). Also the refrigerant circuit 500 includes a receiver 540. In an embodiment, the refrigerant circuit 500 further includes a filter 550. The refrigerant circuit 500 also includes an expansion device 560. Also the refrigerant circuit 500 includes an evaporator 570 and a compressor 580. It will be appreciated that the compressor 580 can be a single compressor or multiple (e.g., two) compressors that share the same suction line and the same discharge line.

The compressor 580 is in fluid communication with the evaporator 570. In an embodiment, the compressor 580 is located downstream of the evaporator 570 with respect to the working fluid flow. The working fluid flows out of the evaporator 570 and flows into the suction line that connects to the suction port of the compressor 580.

The compressor 580 is also in fluid communication with the condenser 510. In an embodiment, the condenser 510 is located downstream of the compressor 580 with respect to the working fluid flow. The working fluid flows out of the discharge port of the compressor 580, and flows into the inlet(s) of the condenser 510 via the discharge line that connects to the discharge port of the compressor 580.

It will be appreciated that the condenser 510 can be an air cooled condenser. The condenser 510 can have two or more slabs of coil. The condenser 510 can also include multiple (e.g., two) condensers in multiple (e.g., two) condenser circuits. For example, in a "W" shaped design, there can be two condenser circuits, where each circuit includes one condenser, and where each condenser has two slabs of coil.

In an embodiment, the discharge line that connects to the discharge port of the compressor 580 is in fluid communication with the slabs (e.g., two or more slabs) of coil the condenser 510. In an embodiment, one (or more) of the slab(s) is controlled by a flow control device 515. The flow control device(s) 515 can be but are not limited to, for example, a valve, a solenoid valve, or a stepping motor valve. The flow control device(s) 515 in an embodiment can be controlled by a controller (such as the controller 2 of FIG. 1). The flow control device(s) 515 can be disposed upstream of the slabs of coil of the condenser 510 with respect to the working fluid flow. The flow control device(s) 515 can be controlled to activate (e.g., when the flow control device(s) 515 is/are opened to allow the working fluid to flow through) or isolate (e.g., when the flow control device(s) 515 is/are closed to prevent the working fluid from flowing through) the slabs of coil the condenser 510.

Embodiments disclosed herein can provide low maintenance and/or low cost. The control design of the flow control device(s) can provide a mechanical solution (e.g., no associated component needs to be updated) to provide low (turn down) and high (turn up) temperatures while maintaining smooth operation without (or minimizing) additional working fluid charge (e.g., 80% of the working fluid charge can be saved) to the chiller. The heat recovery low temperature can be, for example, at or about 60° F. The heat recovery high temperature can be, for example, at or about 135° F. As such, the design can allow the heat recovery operation without adding much additional working fluid charge, and/or reduce the need for extra working fluid charge during the heat recovery operation. Also the design can potentially eliminate the need for a receiver or require only a small receiver.

As shown in FIG. 5, the condenser 510 can include two slabs of coil. One slab of coil is controlled by the flow control device(s) 515. In operation, the slab of coil controlled by the flow control device(s) 515 can be isolated when the flow control device(s) 515 is closed. In such scenario, one slab of coil is activated (there is no flow control device(s) to control the working fluid flow) and the other slab of coil is isolated, and thus the condenser 510 is "split" in terms of the slab(s). It will be appreciated that in another embodiment, each slab of coil can be controlled to be activated or isolated by a corresponding flow control device(s).

It will be appreciated that in the modular design where the condenser has multiple slabs of coil, the number of slabs of coil that can be activated or oscillated can vary. In the modular design, each condenser circuit can have a condenser with multiple slabs of coil. Depending on the required heat recovery capacity, the system can activate and/or isolate as many slabs of coil to tune in for a specific heat recovery capacity and/or specific maximum heat recovery capacity.

Embodiments disclosed herein can enable high and/or low capacities (e.g., heat recovery capacities) with no or little additional working fluid charge. The design can reduce the additional working fluid charge and allow the chiller to maintain the working fluid flow required. As such, the design can allow for lower capacity of heat recovery and therefore less cost if a total heat recovery is not needed.

In another embodiment, the discharge line that connects to the discharge port of the compressor 580 is in fluid communication with the condenser 510. The condenser 510 can include multiple (e.g., two) condensers in multiple circuits (e.g., in the "W" shaped design). One or more of the condensers is controlled by the flow control device(s) 515. The flow control device(s) 515 in one example can be solenoid valves controlled by a controller (such as the controller 2 of FIG. 1). The flow control device(s) 515 can be disposed upstream of the condensers with respect to the working fluid flow. The flow control device(s) 515 can be controlled to be opened to allow the working fluid to flow through the condensers, or to be closed to prevent the working fluid from flowing through the condensers.

As shown in FIG. 5, the condenser 510 can include two condensers. One condenser is controlled by the flow control device(s) 515. In operation, the condenser controlled by the flow control device(s) 515 can be isolated when the flow control device(s) 515 is closed. In such scenario, one condenser is activated (there is no flow control device(s) to control the working fluid flow) and the other condenser is isolated, and thus the condenser 510 is "split" in terms of the condenser(s) in the circuit(s).

It will be appreciated that there can be combinations of "split" when there are multiple condensers having multiple slabs of coil. For example, each condenser can be "split" in terms of its slabs of coil (e.g., some slab(s) of coil are activated and some slab(s) of coil are isolated). The condensers can also be "split" in terms of the condensers (e.g., some condenser(s) are activated and some condenser(s) are isolated). It will also be appreciated that in an embodiment, all slab(s) of coil can be activated or isolated. It will further be appreciated that in an embodiment, all condenser(s) can be activated or isolated.

It will be appreciated that the term "split" can be defined as separating and controlling the slab(s) of coil of a condenser by valve(s) so that some (e.g., one or more) slab(s) of coil are activated and some slab(s) of coil are isolated for heat recovery, or separating and controlling the condenser(s) by valve(s) so that some condenser(s) are activated and some condenser(s) are isolated for heat recovery.

Embodiments disclosed herein can provide up to 120% heat recovery, prevent long term chiller damage, and prevent decreased reliability by reducing the extra working fluid needed for heat recovery.

The discharge line is in fluid communication with the inlet of each slab of coil of the condenser 510 (or the inlet of each condenser of the condenser 510 when the condenser 510 includes multiple condensers). One or more of the slab(s) of coil of the condenser 510 (or one or more of the condenser of the condenser 510 when the condenser 510 includes multiple condensers) is/are controlled by the flow control device(s) 515. When the flow control device(s) 515 is/are closed, the condenser 510 is split (e.g., a portion of the condenser 510 is isolated for heat recovery).

Embodiments disclosed herein can provide low working fluid charge, allow smooth startups and/or shutdowns of the heat recovery system, and avoid complicated restarts.

It will be appreciated that in an embodiment, the working fluid flow to the condenser 510 can be controlled via one or more flow control device(s) (e.g., valve(s), check valve(s), electronic flow pressure regulating valve(s), or the like) to control the working fluid flow to the condenser 510 and/or be controlled to tune the reduction of the active surface of the condenser 510, by a controller (such as the controller 2 of FIG. 1).

Each slab(s) of coil of the condenser 510 (or each condenser of the condenser 510 when the condenser 510 includes multiple condensers) has an outlet. Each outlet is controlled for example by a valve (516, 517). The valve (516, 517) can be a check valve. The valve (516, 517) can prevent the working fluid from flowing back into the condenser 510. All the outlet(s) of the condenser 510 are in fluid communication with an inlet of the receiver 540. A flow control device 590 is disposed upstream of the inlet of receiver 540 and downstream of the valve (516, 517) with respect to the working fluid flow. In an embodiment, the flow control device 590 can be an electronic flow pressure regulating valve. In an embodiment, the flow control device 590 can be a ball valve. In an embodiment, the flow control device 590 can be an automatic electronic expansion valve. It will be appreciated that for cooling mode, embodiments disclosed herein can provide better efficiency; for heating mode, embodiments disclosed herein can provide smooth operation and can move from a high heating capacity to a low heating capacity in a short period of time without causing interruption to operation of the chiller 501. Embodiments disclosed herein can provide required heat recovery temperatures with easy control, quick, and smooth operation.

The flow control device 590 can accomplish high and low heating capacities with stable control. The flow control device 590 can control the extra charge in the receiver 540 and regulates the refrigerant flow of the chiller 501.

The chiller 501 can control the flow control device 590 to provide the required heat recovery capacity. The chiller 501 can also monitor the heat recovery inlet water temperature to analyze and regulate the impact on the condensing pressure.

In an embodiment, for parallel heat recovery, there may be two modes of operation. For example, in a cooling operation, at or about 60 psid might be selected as a setpoint. For example, in a heating operation, a differential pressure may be part of the control to obtain the heat recovery temperature. Suitable controllers can be configured to control the pressure regulating valve to obtain the heat recovery temperature.

When hear recovery starts during chiller operation, water/fluid to be heated may be relatively cold and when cold water is introduced to the heat recovery heat exchanger, the refrigerant throughout the chiller may flows to the heat recovery condenser, which may in some circumstances, cause pressure fluctuation and disturbance in chiller operation (or potential chiller shutdown). With the electrical pressure regulating valve, the pressure can be controlled in the condenser and can gradually (e.g. soft startup) to get the heat recovery water temperature needed without disturbing chiller operation or disturbing the cooling capacity. In an embodiment, the two heat exchangers (condenser and heat recovery) may be run at the same time.

Soft water flow may be used in some cases to help smooth the operation of heat recovery by introducing the heat recovery water at low flow and gradually increase water flow to limit disturbance to chiller operation. For example, soft water flow can be used for series arrangement heat recovery. For parallel arrangement heat recovery, the electrical pressure regulating valve can keep chiller operation smooth without the need for soft water flow.

The flow control device 590 can allow the heat recovery system to start-up and shutdown smoothly without the need for soft water flow at start-up and shutdown to avoid quick change in working conditions. The flow control device 590 can allow for soft startups and shutdowns, can avoid complicated restarts, and can allow the chiller 501 to stay operational at all conditions.

Embodiments disclosed herein can also allow the chiller to stay operational at all conditions without adding much of extra working fluid charge.

In an embodiment, the discharge line that connects to the discharge port of the compressor 580 is in fluid communication with an inlet of the heat recovery condenser 530. The heat recovery condenser 530 and the condenser 510 are arranged in parallel for a heat recovery. An outlet of the heat recovery condenser 530 is in fluid communication with the inlet of the receiver 540. A flow control device(s) 535 (e.g., a solenoid valve) is disposed upstream of the receiver 540 and downstream of the outlet of the heat recovery condenser 530 with respect to the working fluid flow. The flow control device(s) 535 can regulate the working fluid flow from the heat recovery condenser 530 to the receiver 540.

In an embodiment, an outlet of the receiver 540 is in fluid communication with an inlet of the subcooler 520. An outlet of the subcooler 520 is in fluid communication with an inlet of the filter 550. An outlet of the filter 550 is in fluid communication with an inlet of the expansion device 560 (e.g., an expansion valve, an expansion valve, orifice, expander, or the like). An outlet of the expansion device 560 is in fluid communication with an inlet of the evaporator 570.

Embodiments disclosed herein can provide flexibility and allow smooth operation of the heat recovery system due to less working fluid charge to be managed in the system, thereby enhancing the system reliability.

ASPECTS

It is appreciated that any of aspects 1-15, 16, and 17 can be combined.

Aspect 1. A heating, ventilation, air conditioning and refrigeration (HVACR) unit for an HVACR system, the HVACR unit comprising:

a compressor having a motor and a drive;

a condenser fluidly connected to the compressor, a subcooler is located downstream of the condenser;

an evaporator fluidly connected to the subcooler;

a controller; and a bypass assembly connected to the condenser, the bypass assembly having a bypass flow control device and a bypass fluid line controlled by the bypass flow control device, wherein when a heat recovery demand is detected by the controller, the controller is configured to open the bypass flow control device to allow a first portion of working fluid to bypass the condenser or the subcooler.

Aspect 2. The HVACR unit of aspect 1, wherein a first end of the bypass fluid line is located upstream of an inlet of the subcooler.

Aspect 3. The HVACR unit of aspect 1 or aspect 2, wherein when the heat recovery demand is not detected by the controller, the controller is configured to open the bypass flow control device to allow a second portion of working fluid to bypass the subcooler.

Aspect 4. The HVACR unit of aspect 3, wherein the first portion of working fluid is greater than the second portion of working fluid.

Aspect 5. The HVACR unit of any one of aspects 1-4, wherein the first portion of working fluid is at or about 50% or more of the working fluid.

Aspect 6. The HVACR unit of any one of aspects 3-5, wherein the second portion of working fluid is at or about 10% or less of the working fluid.

Aspect 7. The HVACR unit of aspect 1, wherein a first end of the bypass fluid line is located upstream of an inlet of the condenser.

Aspect 8. The HVACR unit of aspect 1 and 7, wherein when the heat recovery demand is not detected by the controller, the controller is configured to open the bypass flow control device to allow a second portion of working fluid to bypass the condenser and the subcooler.

Aspect 9. The HVACR unit of aspect 8, wherein the first portion of working fluid is greater than the second portion of working fluid.

Aspect 10. The HVACR unit of any one of aspects 1 and 7-9, wherein the first portion of working fluid is at or about 50% or more of the working fluid.

Aspect 11. The HVACR unit of any one of aspects 8-10, wherein the second portion of working fluid is at or about 10% or less of the working fluid.

Aspect 12. The HVACR unit of any one of aspects 1-11, further comprising:

an expander located between the condenser and the evaporator, wherein a second end of the bypass fluid line is located upstream of the expander.

Aspect 13. The HVACR unit of any one of aspects 1-12, wherein the condenser is a microchannel condenser.

Aspect 14. The HVACR unit of any one of aspects 1-13, wherein the HVACR unit is an air-cooled chiller.

Aspect 15. The HVACR unit of any one of aspects 1-13, wherein the HVACR unit is an air-cooled chiller coupled with a heat recovery system.

Aspect 16. A method for controlling working fluid flow in a heating, ventilation, air conditioning and refrigeration (HVACR) unit for an HVACR system, the method comprising:

detecting, by a controller, a heat recovery demand;

when the heat recovery demand is detected, opening a bypass flow control device to allow a first portion of working fluid to bypass a condenser or a subcooler; and when the heat recovery demand is not detected, opening the bypass flow control device to allow a second portion of working fluid to bypass the condenser or the subcooler.

Aspect 17. A method for controlling working fluid flow in a heating, ventilation, air conditioning and refrigeration (HVACR) unit for an HVACR system, the method comprising:

detecting, by a controller, a heat recovery capacity of the HVAC unit, the heat recovery capacity including a first heat recovery capacity and a second heat recovery capacity;

when the first heat recovery capacity is detected, opening a flow control device to allow working fluid to flow through a first portion of a condenser or through a first condenser; and when the second heat recovery capacity is detected, closing the flow control device to prevent working fluid from flowing through the first portion of the condenser or through the first condenser.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This specification and the embodiments described are exemplary only, with the true scope and spirit of the disclosure being indicated by the claims that follow.

What is claimed is:

1. A heating, ventilation, air conditioning and refrigeration (HVACR) unit for an HVACR system, the HVACR unit comprising:

a compressor having a motor and a drive;

a heat recovery heat exchanger fluidly connected to the compressor;

a condenser unit including a condenser and a subcooler, the condenser being fluidly connected to the heat recovery heat exchanger, the subcooler being located downstream of the condenser;

an evaporator fluidly connected to the subcooler;

a controller; and a bypass assembly connected to the condenser, the bypass assembly having a bypass flow control device and a bypass fluid line controlled by the bypass flow control device, wherein when a heat recovery operation is detected by the controller, the controller is configured to open the bypass flow control device to allow a first portion of working fluid to bypass the subcooler, wherein the heat recovery operation is detected by the controller when the controller determines that a temperature of process fluid leaving the heat recovery heat exchanger is greater than a temperature of process fluid entering the heat recovery heat exchanger, or when a process fluid flow in a process fluid loop of a heat recovery system having the heat recovery heat exchanger is detected by the controller, wherein a first end of the bypass fluid line is located upstream of an inlet of the subcooler, wherein when the heat recovery operation is not detected by the controller, the controller is configured to open the bypass flow control device to allow a second portion of working fluid to bypass the subcooler.

2. The HVACR unit of claim 1, wherein the first portion of working fluid is greater than the second portion of working fluid.

3. The HVACR unit of claim 1, wherein the second portion of working fluid is at or about 10% or less of the working fluid.

4. The HVACR unit of claim 1, wherein the first portion of working fluid is at or about 50% or more of the working fluid.

5. The HVACR unit of claim 1, wherein the first end of the bypass fluid line is located upstream of an inlet of the condenser.

6. The HVACR unit of claim 5, wherein when the heat recovery operation is not detected by the controller, the controller is configured to open the bypass flow control device to allow the second portion of working fluid to bypass the condenser and the subcooler.

7. The HVACR unit of claim 6, wherein the first portion of working fluid is greater than the second portion of working fluid.

8. The HVACR unit claim 6, wherein the second portion of working fluid is at or about 10% or less of the working fluid.

9. The HVACR unit of claim 5, wherein the first portion of working fluid is at or about 50% or more of the working fluid.

10. The HVACR unit of claim 1, further comprising:

an expander located between the condenser and the evaporator, wherein a second end of the bypass fluid line is located upstream of the expander.

11. The HVACR unit of claim 1, wherein the condenser is a microchannel condenser.

12. The HVACR unit of claim 1, wherein the HVACR unit is an air-cooled chiller.

13. The HVACR unit of claim 1, wherein the HVACR unit is an air-cooled chiller coupled with a heat recovery system.

14. A method for controlling working fluid flow in the HVACR unit of claim 1, the method comprising:

detecting, by the controller, the heat recovery operation;

when the heat recovery operation is detected, opening the bypass flow control device to allow the first portion of working fluid to bypass the subcooler of the condenser unit; and when the heat recovery operation is not detected, opening the bypass flow control device to allow the second portion of working fluid to bypass the subcooler, wherein the heat recovery operation is detected by the controller when the controller determines that the temperature of process fluid leaving the heat recovery heat exchanger is greater than the temperature of process fluid entering the heat recovery heat exchanger, or when the process fluid flow in the process fluid loop of the heat recovery system having the heat recovery heat exchanger is detected by the controller.

15. The HVACR unit of claim 1, wherein the heat recovery operation is not detected by the controller when the controller determines that the temperature of process fluid leaving the heat recovery heat exchanger is equal to the temperature of process fluid entering the heat recovery heat exchanger, or when the process fluid flow in the process fluid loop of the heat recovery system having the heat recovery heat exchanger is not detected by the controller.

16. The HVACR unit of claim 15, wherein when the heat recovery operation is detected by the controller, the HVACR unit operates at a heat recovery mode, when the heat recovery operation is not detected by the controller, the HVACR unit operates at a cooling mode.

17. The method of claim 14, wherein the heat recovery operation is not detected by the controller when the controller determines that the temperature of process fluid leaving the heat recovery heat exchanger is equal to the temperature of process fluid entering the heat recovery heat exchanger, or when the process fluid flow in the process fluid loop of the heat recovery system having the heat recovery heat exchanger is not detected by the controller.

* * * * *